United States Patent [19]

Dickens

[11] 4,299,324

[45] Nov. 10, 1981

[54] FOLDING BEVERAGE CAN CONTAINER

[76] Inventor: Robert E. Dickens, 910 Bridgestone, Rochester, Mich. 48063

[21] Appl. No.: 87,038

[22] Filed: Oct. 22, 1979

[51] Int. Cl.[3] ..... B65D 5/36; B65D 5/46; B65D 33/06; B65D 30/22

[52] U.S. Cl. ..... 206/170; 206/428; 229/15; 229/52 A; 229/56

[58] Field of Search ..... 229/56, 68 R, 72, DIG. 3, 229/15, 41 R, 41 B, 1.5 R, 52 A; 206/170, 174, 178, 428

[56] References Cited

U.S. PATENT DOCUMENTS

| | | | |
|---|---|---|---|
| 814,950 | 3/1906 | Evans | 229/1.5 R |
| 979,213 | 12/1910 | Shedd | 229/68 R |
| 2,603,409 | 7/1952 | Crary | 229/52 A X |
| 2,653,752 | 9/1953 | Vogt | 229/56 |
| 3,114,496 | 12/1963 | Wilcox | 206/428 X |
| 3,447,733 | 6/1969 | Smith et al. | 229/15 X |
| 3,933,294 | 1/1976 | Meenan et al. | 229/1.5 R |

FOREIGN PATENT DOCUMENTS

| | | | |
|---|---|---|---|
| 160423 | 1/1955 | Australia | 229/72 |

*Primary Examiner*—Stephen P. Garbe

*Attorney, Agent, or Firm*—Basile, Weintraub & Hanlon

[57] ABSTRACT

A compartmented container for returnable beverage cans made from plastic sheet is disclosed. The container of the present invention comprises a plurality of spaced apart parallel upright walls including a pair of opposed side walls joining the spaced apart upright walls at an outside edge thereof. A bottom wall extends along the bottom of the container and joins the bottom edges of the upright walls, side edges of the bottom wall spaced in a distance from the opposed side walls. Fold lines are formed transversely along the bottom wall between upright walls, and upright fold lines are formed along the side wall between upright walls. The container is foldable along the fold lines collapsing to a thin planar configuration with the upright walls abutting.

5 Claims, 3 Drawing Figures

FOLDING BEVERAGE CAN CONTAINER

BACKGROUND OF THE INVENTION

I. Field of the Invention

The present invention relates generally to the field of containers for returnable beverage containers. More specifically the present invention relates to the field of containers for returnable beverage containers made from plastic. Even more specifically the present invention relates to the field of containers for returnable beverage containers made from plastic sheet. Even more particularly the present invention relates to the field of containers made from plastic sheet for returnable metal beverage cans that is collapsible or foldable to a planar form.

II. Cross Reference to Related Applications

This application is related to the applicant's copending application Ser. No. 080,237 filed Oct. 1, 1979 entitled "Wire Container for Returnable Beverage Cans."

III. Description of the Prior Art

In recent years there has been a deep concern by the public for reducing litter in our public parks and along roadways. In addition, the public concern for reducing energy consumption together with reducing unsightly litter has led to mandatory returnable beverage container laws in many states. The present invention is directed toward fulfilling this public need by providing a convenient and inexpensive container for collecting returnable beverage cans for their return for recycling purposes. Typical containers for returnable beverage containers in the prior art are disclosed in U.S. Pat. Nos.: 3,484,019; 3,565,278; 3,584,758; and 3,998,328. These patents are relevant in that they disclose containers for returnable beverage containers such as bottles.

U.S. Pat. No. 3,484,019 discloses a collapsible bottle carrying container made from cardboard which carries the bottles in an upright position.

U.S. Pat. Nos. 3,565,278; 3,584,758; and 3,998,328 disclose plastic containers made from molded plastic for carrying bottles in an upright position with the containers having compartments to separate individual bottles.

U.S. Pat. No. 2,695,723 discloses a sectional receptacle made from molded plastic that is employed for carrying fragile articles such as cigars. None of the above listed U.S. patents disclose the present invention of a disposable folding beverage can container made from plastic sheet for returnable beverage cans.

IV. Prior Art Statement

The aforementioned prior art, including the applicant's copending application, in the opinion of the applicant and the applicant's attorney, represents the closest prior art of which the applicant and the applicant's attorney are aware.

SUMMARY OF THE INVENTION

The present invention, which will be described in greater detail subsequently, comprises a compartmented container for returnable beverage cans made from sheet plastic. The container includes a plurality of spaced apart parallel upright walls and a pair of opposed side walls joining the spaced apart upright walls along their outside edges. The container also includes a planar bottom wall joining the bottom edges of the upright walls to enclose the container leaving an open top. Transverse fold lines are formed along the bottom wall between the upright walls and vertical fold lines are formed in the opposed side walls between the upright walls. By folding the container along the fold lines, the container is collapsible to a thin planar form with the upright walls abutting. A handle is provided comprising a first transverse upper planar piece with a pair of opposed downward extending legs integral with the upper piece, a lower end of the legs is bonded to an upper edge of the opposed side walls.

It is therefore an object of the present invention to provide a container for returnable beverage containers.

It is a further object of the present invention to provide a container for returnable beverage containers made from inexpensive plastic sheet.

It is a further object of the present invention to provide a container for returnable beverage containers made from plastic sheet that is collapsible into a thin planar form.

It is a further object of the present invention to provide a container for returnable beverage containers such as cans that are recyclable.

It is yet another object of the present invention to provide a container for returnable beverage containers such as cans made from plastic sheet that is collapsible and disposable.

For a more complete understanding of the present invention, reference is made to the following detailed description and accompanying drawings.

Other objects, advantages, and applications of the present invention will become apparent to those skilled in the field to which this invention pertains, when the accompanying description of the best modes contemplated for practicing the invention are read in conjunction with the accompanying drawings.

BRIEF DESCRIPTION OF THE DRAWINGS

In the drawings, like reference numbers refer to like parts throughout the several views, and wherein.

DESCRIPTION OF THE PREFERRED EMBODIMENT

Figure 1:
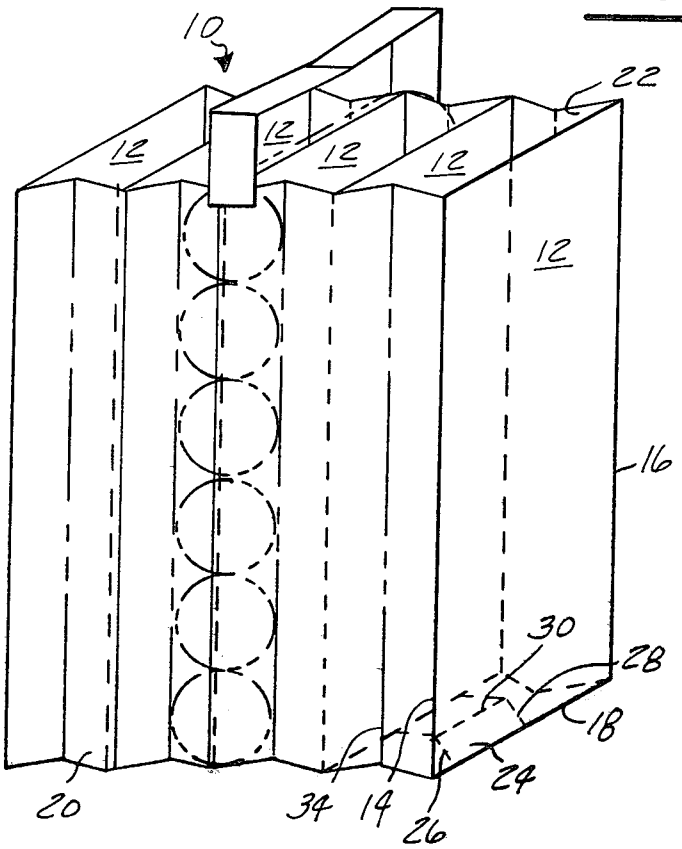
FIG. 1 illustrates a perspective view of the compartmented container of the present invention.

Referring now to the drawings, there is illustrated one example of the invention in FIG. 1 at 10 in the form of a compartmented container. The container 10 comprises a plurality of spaced upright walls 12 including a pair of opposed outside edges 14,16 and a bottom edge 18. A first pair of opposed side walls 20,22 join the spaced apart upright walls 12 at their outside edges 14,16, and a planar bottom wall 24 joins the bottom edges 18 to form an enclosed container with an open top. The planar bottom wall further includes outside edges 26,28 spaced in from the side walls 20,22 and a plurality of transverse fold lines 30 positioned between the upright walls 12. The side walls 20,22 include a plurality of vertical fold lines 32 positioned between the upright walls 12, and when the bottom and side walls are selectively folded along their respective fold lines the container is collapsible to a flat planar shape with the upright walls 12 abutting.

Figure 2:
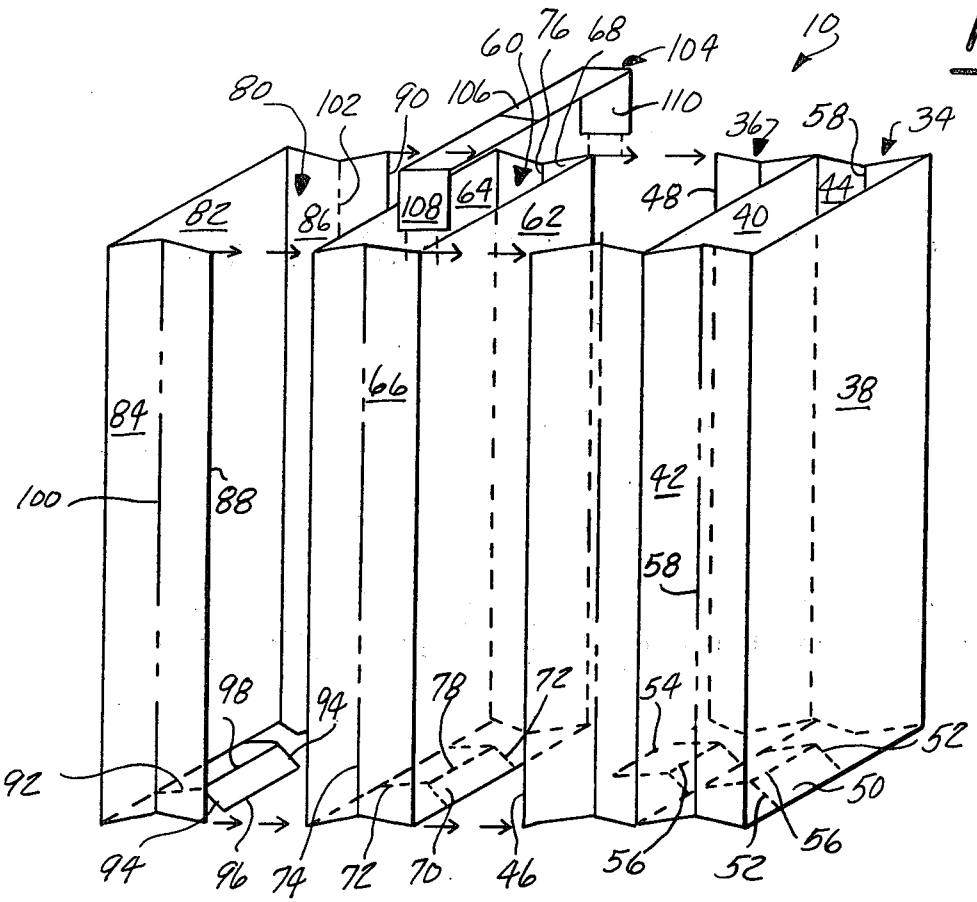
FIG. 2 illustrates an exploded perspective view of the compartmented container of FIG. 1.

The compartmented container 10 is formed from an assembly of compartments as illustrated in the exploded perspective view in FIG. 2. A first compartment 34 and a second compartment 36 comprise a first end wall 38 and a first upright wall 40 spaced from and parallel to the first end wall 38, with a first side wall 42 and a second side wall 44 interconnected to the end wall. The first side wall 42 and the second side wall 44 extend past the first upright wall 40 a distance to a first side wall inner edge 46 and a second side wall inner edge 48. A first bottom wall 50 having side edges 52 spaced in from the first and second side walls 42,44 is interconnected to a bottom edge of the first end wall 38 and a bottom edge of the first upright wall 40 extending past the first upright wall 40 a distance to a first bottom wall inner edge 54. Transverse fold lines 30 are formed along the first bottom wall 50 between the first end walls 38 and the first upright wall 40 and between the first upright wall 40 and the first bottom wall inner edge 54. Vertical fold lines 58 are formed in the first side wall 42 and the second side wall 44 between the first end wall and the first vertical wall and between the first vertical wall and the first and second side wall inner edges. Transverse fold lines 56 are formed along the first bottom wall between the first end wall 38 and the first upright wall 40 and between the first upright wall 40 and the first side wall inner edge 46.

A third compartment 60 includes a second spaced apart parallel vertical wall 62 and a third parallel spaced apart vertical wall 64. A third side wall 66 and a fourth side wall 68 extend between the second and third vertical walls and are integral therewith. A second bottom wall 70 includes side edges 72 spaced in from the third and fourth side walls extending between and integral with the second and third vertical walls along their lower edges. Vertical fold lines 74,76 are formed in the third and fourth side walls respectively, and transverse fold lines 78 are formed in the second bottom wall between the second and third vertical walls. The third and fourth side walls and the second bottom wall are foldable along their fold lines allowing the second and third vertical walls to abut in a folded position.

A fourth compartment 80 comprises a second end wall 82 and fifth and sixth side walls 84,86 integral with the second end wall extending inward and terminating at fifth and sixth side wall inner edge 88,90 respectively. A third bottom wall 92 having side edges 94 spaced in from the fifth and sixth side walls is integral with the second end wall extending inward a distance terminating at a third bottom wall inner edge 96. A third bottom wall transverse fold line 98 extends transversely across the third bottom wall, and a fifth side wall vertical fold line 100 extends vertically along the fifth side wall 84 with a sixth side wall vertical fold line 102 extending vertically along the sixth side wall 86.

To assemble the compartments into the compartmented container 10, the bottom wall inner edge 54 is bonded to the second bottom wall 70, and the first and second side wall inner edges 46,48 are bonded to the second and third side walls 66,68 respectively, then the fifth and sixth side wall inner edges 88,90 are bonded to the third and fourth side walls 66,68 with the third bottom wall inner edge 96 bonded to the second bottom wall 70 to produce an enclosed container with an open top. When the bottom walls and side walls are folded along their respective fold lines the container 10 is collapsed to a thin planar shape for easy storage and/or shipment.

In a preferred embodiment the compartmented container 10 further includes a first handle 104 comprising a first transverse upper planar piece 106 and a pair of downward extending opposed legs 108,110 integral with the planar piece 106. A lower end of the legs 108,110 is bonded to an upper edge of the third side wall 66 and the fourth side wall 68.

Figure 3:
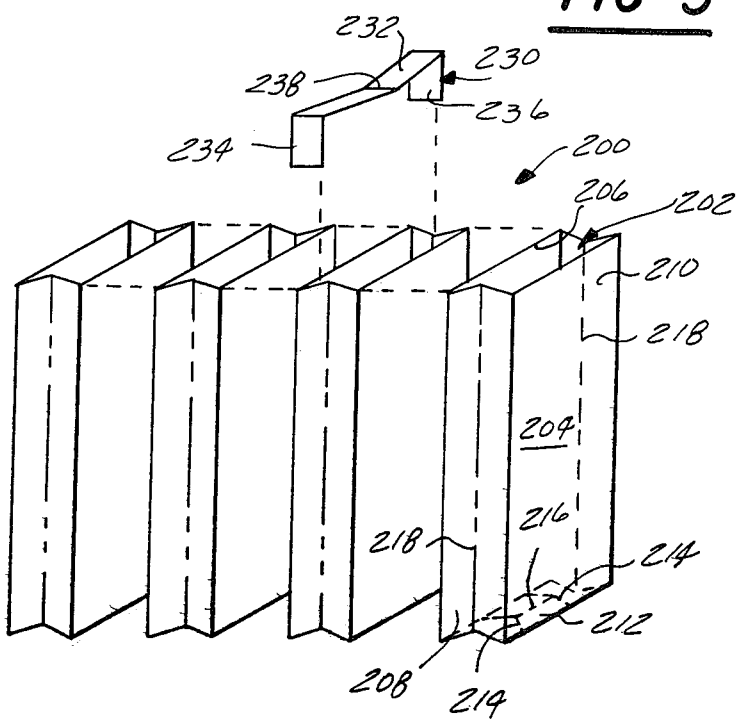
FIG. 3 illustrates an exploded perspective view of a second embodiment of the present invention.

In a second embodiment of the present invention illustrated in FIG. 3, a compartmented container 200 is formed from a plurality of individual identical compartments 202 as will be described subsequently. The compartments 202 comprise a pair of opposed end walls 204,206 integral with a second pair of opposed side walls 208,210. A fourth bottom wall 212 has fourth bottom wall side edges 214 spaced in from the side walls 208,210, and a transverse fold line 216 extending transversely thereacross. Vertical fold lines 218 extend vertically along the opposed side walls 208,210. To assemble the compartmented container 200 the compartments 202 are aligned with at least one end wall 204 in abutment with an adjacent compartment end wall 204, and the abutting end walls are bonded to their adjacent end wall using ultrasonic or heat sealing techniques. When the container 200 has been assembled, the side walls and bottom walls may be folded along their respective fold lines and the container collapsed to a thin planar form for storage or packaging for sale.

The container 200 optionally includes a second handle 230 which comprises a second transverse upper planar piece 232 and a pair of downward extending opposed legs 234,236. A lower end of the legs 234,236 is bonded to the second pair of opposed side walls 208,210 by ultrasonic bonding or by heat bonding or the like. A handle fold line 238 is formed in the middle of the transverse planar piece 232 to facilitate folding of the second handle 230 into the space between end walls 204,206 when the container is collapsed for storage or shipment.

It can thus be seen that the present invention has provided a new and improved compartmented carrier for returnable beverage cans. The compartmented container of the present invention is collapsible for easy storage and transportation and can be readily made from low cost material such as plastic polyvinylchloride sheet or from paper. The cost of manufacturing the present invention is so low that the compartmented container can be discarded after use with little economic consequence.

It should be understood by those skilled in the art to which this invention pertains, that other forms of applicant's invention may be had, all coming within the spirit of the invention and the scope of the appended claims.

Having thus described my invention what I claim is:

1. A compartmented container for returnable beverage cans comprising:

a plurality of spaced apart, parallel upright walls with a pair of opposed outside edges and a bottom edge;

a first pair of opposed side walls joining the spaced apart upright walls at the outside edges;

a planar bottom wall;

a first and second compartment including a first end wall and a first upright wall spaced from and parallel to the first end wall, the opposed side walls comprising a first side wall and a second side wall, the first side wall and second side wall interconnected to the end wall and the first upright wall and extending past the first upright wall a distance to a first and second side wall inner edge, the first and second side walls comprising the only means for forming side walls for said second compartment and extending to a third compartment, a first bottom wall having side edges spaced in from the first and second side walls interconnected to the first end wall and the first upright wall extending past the first upright wall a distance to a first bottom wall inner edge, transverse fold lines formed along the first bottom wall between the first upright wall and the first end wall and between the first upright wall and the first bottom wall inner edge, upright fold lines formed in the first and second side walls between the first end wall and the first upright wall and between the first upright wall and the first and second side wall inner edges;

said third compartment including second and third spaced apart parallel vertical walls, third and fourth side walls extending between the second and third upright walls integral therewith, a second bottom wall with side edges spaced in from the third and fourth side walls extending between the second and third upright walls and integral therewith, upright fold lines formed in the third and fourth side walls and a transverse fold line formed in the second bottom wall between the second and third upright walls, wherein the third and fourth side walls and the second bottom wall are foldable along their fold lines to allow the second and third upright walls to abut in a folded condition;

a fourth compartment comprising a second end wall, a fifth and sixth side wall integral with the second end wall terminating at a fifth and sixth side wall inner edge respectively, a third bottom wall having side edges spaced in from the fifth and sixth side walls integral with the second end wall terminating at a third bottom wall inner edge, a transverse fold line formed in the third bottom wall, a vertical fold line formed in the fifth and sixth side walls;

the first bottom wall inner edge bonded to the second bottom wall, the first and second side wall inner edges bonded to the third and fourth side walls respectively, the fifth and sixth side wall inner edges bonded to the third and fourth side walls respectively, the third bottom wall inner edge bonded to the second bottom wall; and wherein the bottom walls and side walls fold along their fold lines to collapse the container.

2. The container as defined in claim 1 further comprising:

a first handle comprising a first transverse upper planar piece, a first pair of opposed downward extending legs integral with the upper piece, a lower end of the legs bonded to an upper edge of the third and fourth side walls.

3. The compartmented container as defined in claim 1 wherein the container is formed from a plurality of individual compartments comprising:

a pair of opposed end walls;

a second pair of opposed side walls integral with the end walls, a vertical fold line along each second side wall;

a fourth bottom wall integral with the opposed end walls including side edges spaced in from the side walls, a transverse fold line formed in the bottom wall.

4. The compartmented container as defined in claim 3 further comprising:

the compartments aligned with at least one end wall in abutment with an adjacent compartment, the abutting end walls bonded to their adjacent end wall.

5. The container as defined in claim 3 further comprising:

a handle including a transverse upper planar piece;

a pair of opposed downward extending legs integral with the upper piece, a lower end of the legs bonded to an upper edge of the opposed side walls; and a handle fold line formed in the middle of the transverse upper planar piece to facilitate folding of the handle between end walls.

* * * * *